US008434317B2

(12) United States Patent
Besore

(10) Patent No.: US 8,434,317 B2
(45) Date of Patent: May 7, 2013

(54) ANTI-SWEAT HEATER DEMAND SUPPLY MODULE USING TEMPERATURE AND HUMIDITY CONTROL

(75) Inventor: John K. Besore, Prospect, KY (US)

(73) Assignee: General Electric Company, Schenectady, NY (US)

( * ) Notice: Subject to any disclaimer, the term of this patent is extended or adjusted under 35 U.S.C. 154(b) by 262 days.

(21) Appl. No.: 12/913,133

(22) Filed: Oct. 27, 2010

(65) Prior Publication Data

US 2012/0047919 A1 Mar. 1, 2012

Related U.S. Application Data

(63) Continuation-in-part of application No. 12/859,411, filed on Aug. 19, 2010.

(51) Int. Cl.
*F25D 21/00* (2006.01)
*G05D 22/02* (2006.01)

(52) U.S. Cl.
USPC ..... 62/150; 62/176.6; 165/231; 165/233; 236/44 C

(58) Field of Classification Search ..... 62/150, 62/176.6; 165/230, 231, 233; 236/44 C
See application file for complete search history.

(56) References Cited

U.S. PATENT DOCUMENTS

| | | | | |
|---|---|---|---|---|
| 4,332,142 | A | 6/1982 | Prada | |
| 4,822,117 | A | 4/1989 | Boston, Jr. | |
| 5,638,694 | A * | 6/1997 | Banicevic | 62/277 |
| 7,010,363 | B2 * | 3/2006 | Donnelly et al. | 700/19 |
| 2005/0229614 | A1 * | 10/2005 | Ansted | 62/150 |
| 2006/0026975 | A1 * | 2/2006 | Bunch et al. | 62/154 |

* cited by examiner

*Primary Examiner* — Marc Norman
(74) *Attorney, Agent, or Firm* — Global Patent Operation

(57) ABSTRACT

A refrigerated appliance such as a refrigerator receives a demand response signal indicating a peak demand period and operates the refrigerator in an energy savings mode by disabling an anti-sweat heater. Sensors monitor ambient temperature and humidity, and the dry bulb temperature of a preselected region where incipient moisture would likely form. Data from the sensors is sent to a controller which calculates ambient dew point and compares the dry bulb temperature of the preselected region with the calculated dew point to enable the anti-sweat heater during the peak demand period and prevent incipient formation of moisture.

17 Claims, 3 Drawing Sheets

ANTI-SWEAT HEATER DEMAND SUPPLY MODULE USING TEMPERATURE AND HUMIDITY CONTROL

This application is a continuation-in-part of prior co-pending U.S. patent application Ser. No. 12/859,411, filed 19 Aug. 2010, entitled Demand Response Mullion Sweat Protection, the disclosure of which is expressly incorporated herein by reference.

BACKGROUND OF THE DISCLOSURE

This disclosure relates to a demand supply response associated with an appliance, and particularly a refrigerated appliance where operation of the refrigerated appliance may be altered in response to a high demand for energy and peak pricing. Selected aspects may find use in related applications.

It is well known that refrigerators have two or more compartments for storing food items, that is, at least one freezer compartment and at least one fresh food compartment. The locations of the separate compartments may vary. For example, in a bottom mount refrigerator the freezer is located on the bottom and the fresh food compartment is on top, while in a top mount arrangement, the compartments are reversed. In a side-by-side arrangement one side is the freezer compartment and the other side is the fresh food compartment. In still another style, the fresh food compartment includes side-by-side doors and the freezer compartment is located on the bottom. No matter which style is employed, these compartments are divided one from the other by one or more walls that are thermally insulated in order to maintain the temperature in the freezer compartment at, for example, about 0° F. and in the fresh food compartment at approximately 37° F. Of course, these are exemplary temperature ranges only.

Gaskets are provided to seal around access openings to these compartments and the gaskets extend from peripheral regions of doors that close the access openings to the respective compartment. The gaskets sealingly contact a generally planar, perimeter surface of the housing or case that surrounds the access opening when the doors are closed. Thus, the metal or housing surface is exposed to 0° F. air from the freezer compartment, for example, along one edge of the gasket and exposed to ambient air (about 68° F.) associated with the room along another edge of the gasket. Since the metal housing is thermally conductive, a portion of this metal surface (sometimes referred to as a mullion bar), or specifically that housing area between a pair of gaskets, conducts the heat in and conducts the cold out. As a result, a gap region of the housing between the gaskets or adjacent the gaskets is exposed to ambient air and can be at a temperature below the dew point temperature. Fog or moisture can form beads of sweat in this mullion region and the beads can coalesce to form water droplets that potentially reach the floor.

To prevent the formation of moisture or sweat in these regions, a heater such as a low wattage electric resistance heater is typically employed. This heater(s) is sometimes referred to as an anti-sweat or mullion heater. One type of these heaters operates on approximately 8 to 12 watts and is preferably a fine nichrome wire heater wrapped in and insulated by a surrounding vinyl sheathing. The wire is disposed on a cloth carrier that is attached to an adhesive backed foil. These small resistance-type heaters are usually secured to or provided in those areas of the refrigerator where sweat is likely to collect, for example along edges of the door, case flange, mullion, etc.

In a side-by-side refrigerator, the gaskets of the side-by-side doors form a generally vertically extending channel therebetween which can contribute to potential water drippage through the channel. Understandably, water dripping on the floor adjacent the refrigerator is undesirable and thus the anti-sweat heaters are used to raise the temperature in these regions above the dew point.

In response to utility companies beginning to charge higher rates during peak demand periods, there is a desire to control or reduce energy use by appliances which also results in a potential cost savings for the consumer/homeowner. Various responses have been proposed for different appliances, including refrigerators, when higher rates are being charged during peak demand periods. Generally speaking, inactivating or disabling anti-sweat heaters is sometimes avoided as a viable demand response option during peak pricing because of the potential concern that moisture or water could reach the floor. It is recognized that peak pricing periods could last two to four hours or more and, in this time frame, there is the possibility that sweat could develop in such regions. Therefore, because there is a concern about sweat developing on the mullion bar during an extended high or critical rate (particularly in high humidity environments) and that such sweat formation will possibly be exacerbated because the home air conditioning will also be concurrently "controlled" to a condition that will produce increased humidity in the conditioned space, the anti-sweat heaters are typically left operational during peak demand periods. Moreover, 8-12 watts is deemed to be a relatively small energy value and thus proposed demand responses have focused on other energy and cost saving areas that could result in a greater energy savings.

Consequently, a need exists for providing a demand response that addresses the anti-sweat heaters and the potential energy and cost savings associated therewith.

SUMMARY OF THE DISCLOSURE

A refrigerated appliance includes a housing having a cooled storage compartment. An anti-sweat heater warms at least a portion of the housing. A controller operatively connected to one or more power consuming features of the refrigerated appliance is configured to receive and process a demand response signal. In response, the controller inactivates the anti-sweat heater in at least an energy savings mode and selectively activates the anti-sweat heater for at least a limited time period during the energy savings mode. A first temperature sensor and humidity sensor detect an air dry-bulb temperature and humidity, respectively, of an ambient environment near the refrigerated appliance and convey data to the controller to calculate a dew point temperature. A second temperature sensor is operative to detect a surface temperature of a preselected region of the housing and convey this temperature data to the controller. The controller compares the preselected region temperature data with the calculated dew point temperature to determine whether to activate the anti-sweat heater.

The preselected region preferably has a reduced insulation relative to adjacent regions of the housing.

The preselected region is typically located on a mullion.

The second temperature sensor is preferably located in a region of the housing where moisture tends to form prior to forming at other locations, for example, at or adjacent the preselected region.

The sensors are preferably electronic transducers.

A control method for a refrigerated appliance includes receiving a demand response signal indicative of at least a peak demand period and an off-peak demand period. The method further includes operating the appliance in a normal mode during the off-peak demand period and in an energy savings mode during the peak demand period. The method includes disabling an anti-sweat heater during the peak demand period. In response to sensing a surface temperature of an external surface portion of the appliance, calculating an ambient dew point by monitoring the air dry-bulb temperature and humidity of the ambient air adjacent the appliance, comparing the surface temperature with the calculated dew point, the method includes enabling the anti-sweat heater during the peak demand period when the surface temperature approaches the calculated dew point.

The enabling step preferably includes operating the anti-sweat heater for a preselected time period after the surface temperature sensor has diverged from the calculated dew point to prevent short-cycling of the anti-sweat heater.

Locating the first and second transducers at an air inlet to the condenser to sense air temperature and humidity proximate to the condenser is one preferred manner of monitoring the ambient air dry-bulb temperature and humidity.

A primary advantage of the present disclosure is the ability to provide a low cost solution to taking advantage of load shedding in a peak demand period for a refrigerated appliance.

Yet another advantage resides in a low cost solution that can be attained without the concern of sweat or moisture.

Still another advantage is the lack of any moving parts or components that would otherwise lead to failure.

Still another advantage is the ease with which the refrigerated appliance can automatically and easily override a demand response signal to activate the anti-sweat heaters when the controller is calling for deactivation, and deactivate the anti-sweat heaters when the surface temperature exceeds the calculated dew point temperature signaling the propensity for fog or running beads of sweat to form.

Another benefit is the ability to be more aggressive in the load shedding response without being concerned about condensed water dripping on a floor.

Still other benefits and advantages of the present disclosure will become apparent from reading and understanding the following detailed description,

DETAILED DESCRIPTION OF THE PREFERRED EMBODIMENTS

Figure 2:
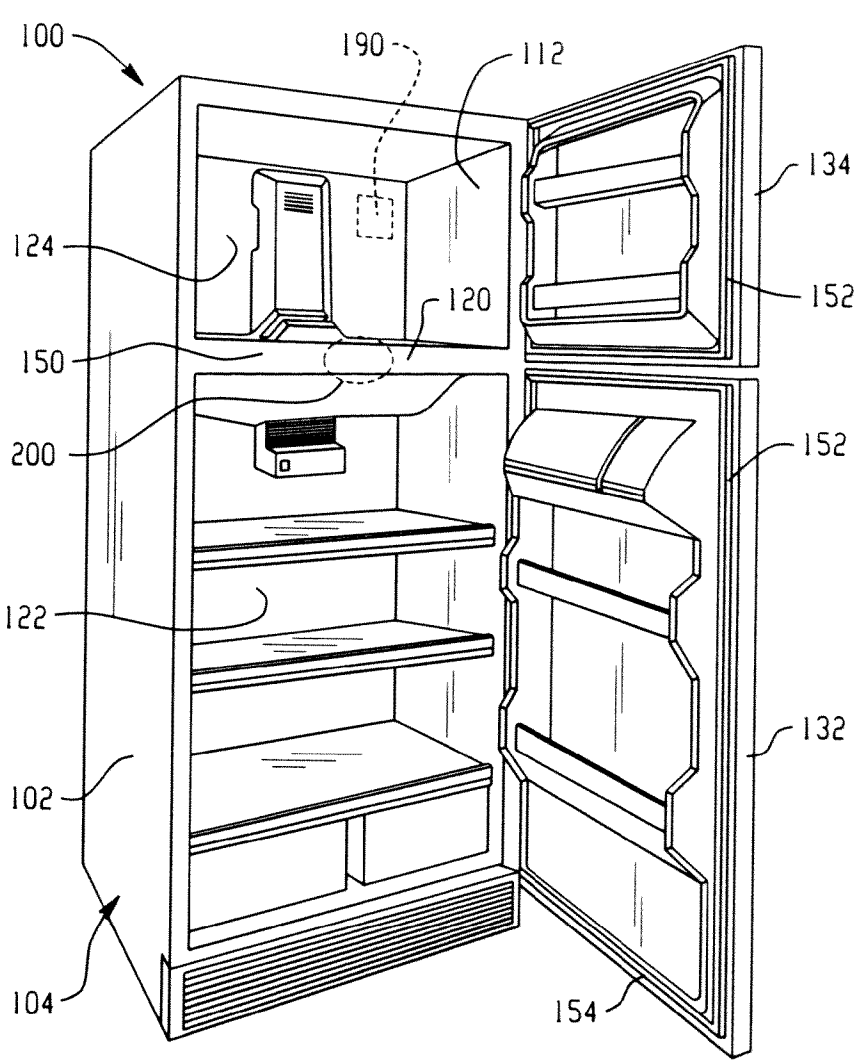
FIGS. 1-4 illustrate various types of refrigerators with which the present disclosure can be used.
Figure 1:
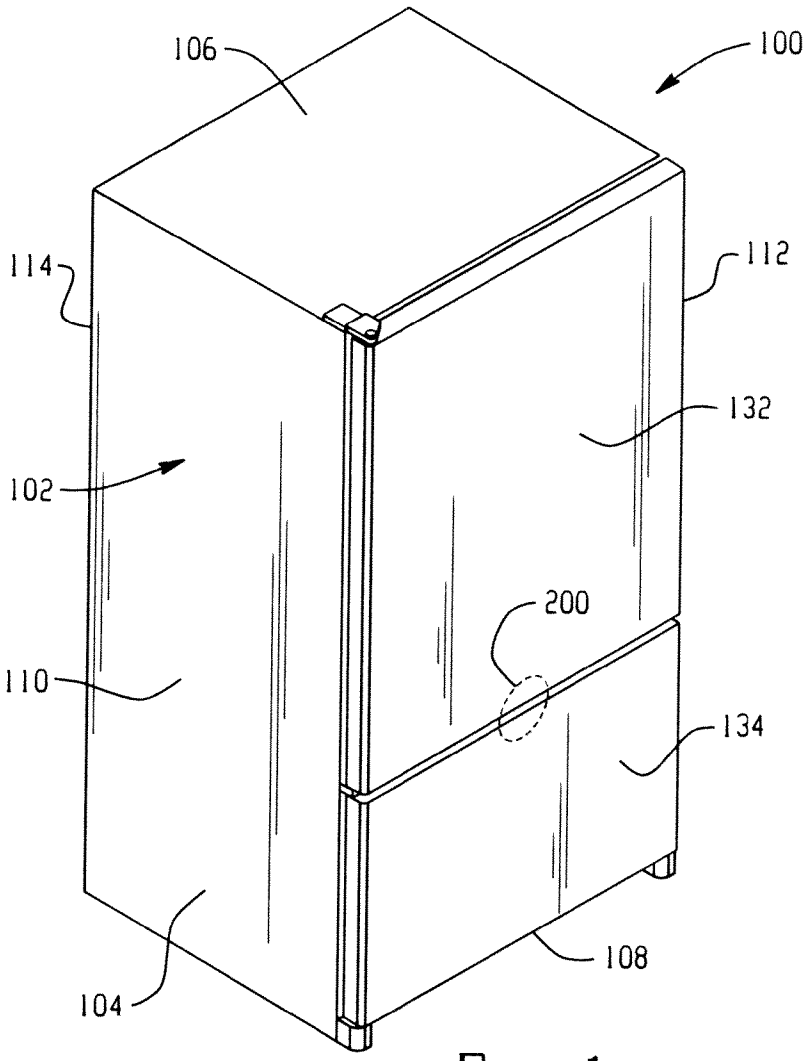

FIGS. 1-4 illustrate various models of refrigerators (or refrigerated appliances such as a freezer, wine chiller, etc. (generally referred to herein as a refrigerated appliance)) 100, and although the various models may have different features, for purposes of the present disclosure, many of these detailed features are not pertinent. Thus, these various types of refrigerated appliances all commonly include at least one cooled storage compartment, and when describing a refrigerator, the appliance preferably includes first and second cooled storage compartments generally referred to as a fresh food storage compartment and a freezer compartment. Therefore, like reference numerals will be used to identify like components throughout FIGS. 1-4 for ease of identification.

Figure 4:
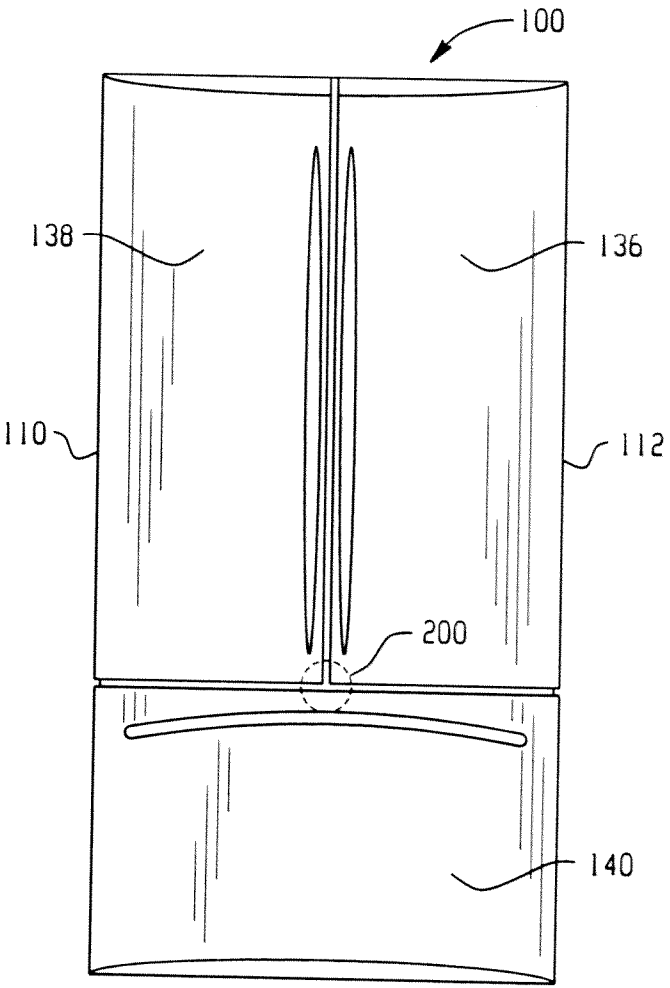
Figure 3:
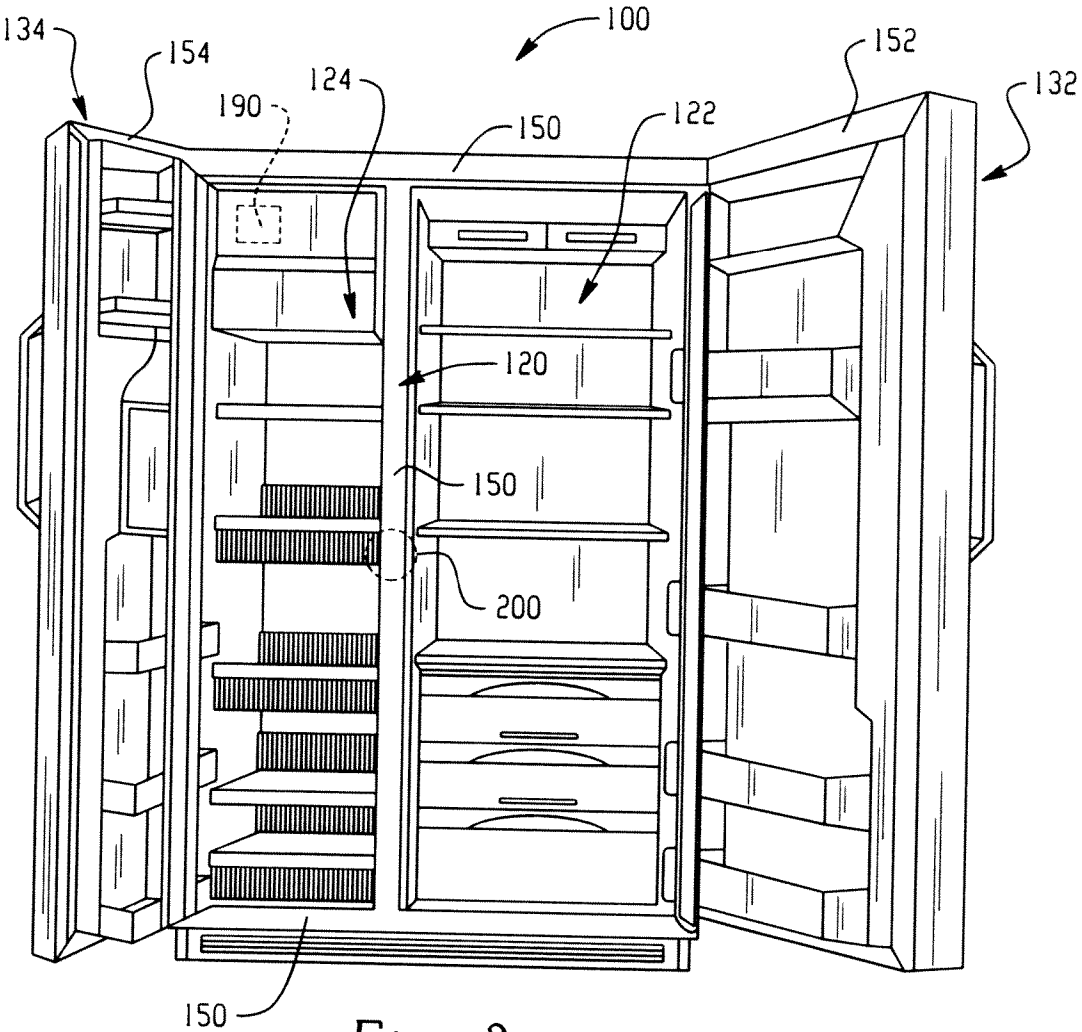

More particularly, the refrigerated appliance or refrigerator 100 has a cabinet 102 that includes an outer case, shell, or housing 104 having a top wall 106, bottom wall 108, sidewalls 110, 112, and a rear or back wall 114. Typically, the housing 104 is formed of a thin metal material and the walls are thermally insulated. At least one dividing wall 120 separates the refrigerator into a fresh food storage compartment 122 and a freezer compartment 124. These compartments 122, 124 can be situated in a bottom mount arrangement where the freezer is on the bottom and the fresh food is on the top (FIG. 1), or a top mount where the freezer is on top and the fresh food compartment is on the bottom (FIG. 2), a side-by-side model as shown in FIG. 3, or more recent vintage model of a fresh food compartment 122 having dual doors disposed on top of a freezer compartment 124 as shown in FIG. 4. Whereas the embodiments of FIGS. 1-3 each include a fresh food storage compartment door 132 and a freezer compartment door 134, the model of FIG. 4 includes a pair of fresh food storage compartment doors 136, 138 that are hinged adjacent the sidewalls 110, 112 and the freezer compartment is not a hinged door but a slidable drawer 140. As is well understood in the art, the fresh food storage compartment 122 and the freezer compartment 124 are separated by the dividing wall 120 and closed off from the ambient environment via the drawer or doors.

Typically the outer surface of the housing 104 is a planar metal surface 150 that is selectively engaged or sealed by gaskets 152, 154 that are provided on perimeter regions of the respective doors or drawer. The housing surfaces 150 selectively engaged by the gaskets are thus exposed to the cooler temperatures of the fresh food storage compartment 122 and the freezer compartment 124 along one edge or region and to ambient air along an adjacent edge or region. When the cooled, refrigerated air impinges on any exposed metal within the refrigerated space, conducts through the cross-section of the gasket, or leaks past the gasket/seal area, the thermally conductive metal surface tends to fall below the dew point of the surrounding atmosphere. These regions, therefore, are prone to potential accumulation of fog, moisture, condensation, etc. that can form water droplets. The representative encircled regions in FIGS. 1-4 are such areas where condensation may accumulate and could lead to water dripping on the floor below the refrigerator. To overcome this problem, anti-sweat heaters are employed in these regions and mounted on an interior surface of the metal housing. These anti-sweat heaters are typically located in the mullion regions, i.e., incorporated along the edges of the door, case flange, mullions, etc. where the gasket typically bears against the housing. Commonly-owned U.S. Pat. Nos. 4,332,142 and 4,822,117 show and describe such anti-sweat or mullion heaters that are employed in prior refrigerators to address the moisture issue. The mullion bars typically have insulation generally uniformly provided along an interior surface of the metal housing, i.e., behind the metal surface, in order to limit thermal conduction from the cooler fresh food and freezer compartments.

Figure 5:
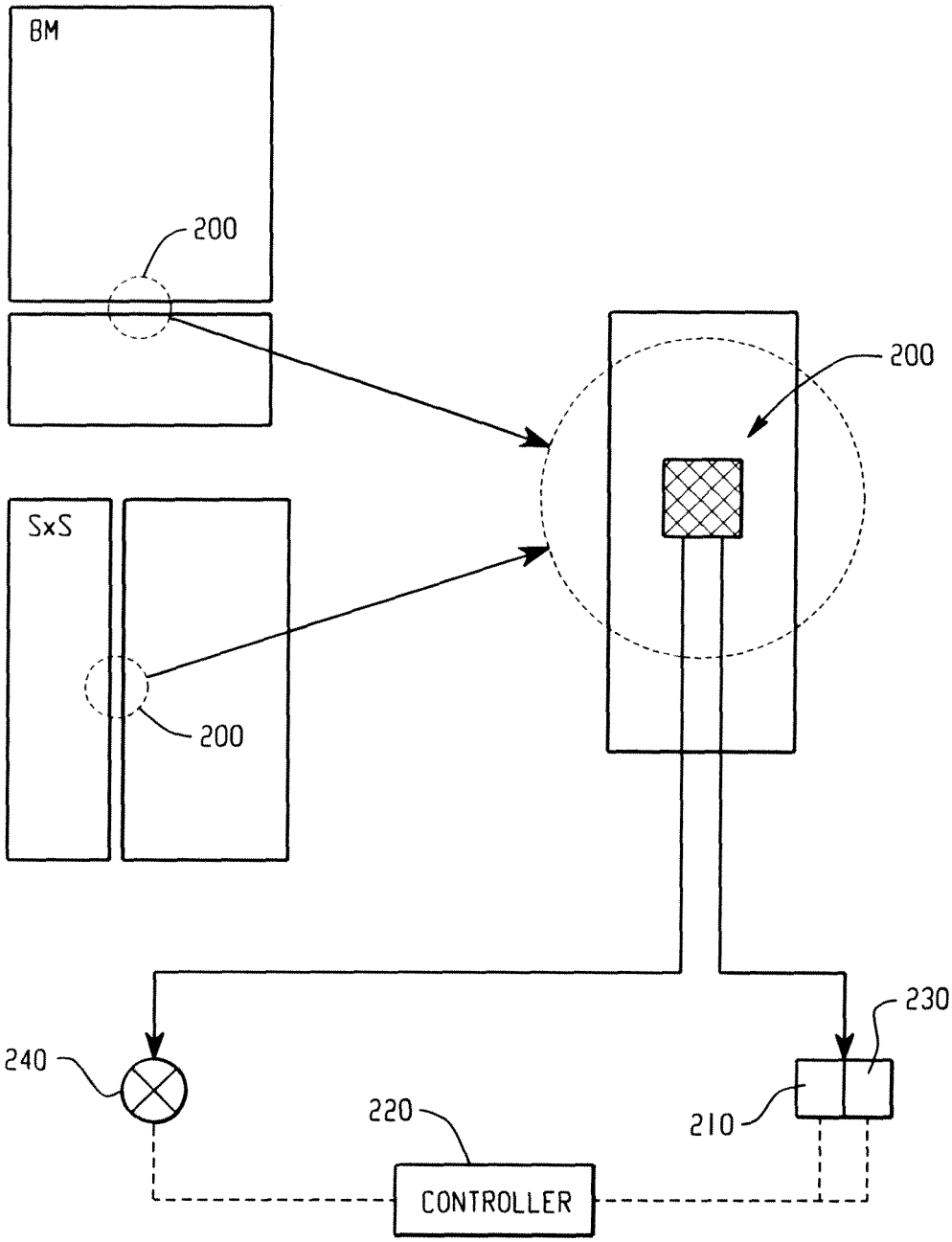
FIG. 5 is an enlarged representation of the encircled areas.

As shown in FIG. 5, a preselected region or location 200 on the housing 104 is preferably defined. In a preferred arrangement, the preselected region 200 is formed as a depressed section, i.e., a region where the fog or sweat may coalesce, and behind the mullion the preselected region preferably has less insulation than adjacent regions of the insulated mullion. As a result, this preselected region will tend to be cooler than adjacent regions or areas of the mullion bar because of the reduced insulation. Moreover, the depressed section acts as a collector for the fog or moisture that may develop in this location so that any moisture that does develop can be reliably considered as the location of incipient formation of moisture or a bead of water on the refrigerated appliance.

With continued reference to FIG. 5, a first temperature sensor 210 may be located along the mullion face that senses the dry bulb temperature or ambient temperature around the refrigerator. The temperature data is provided to controller 220 which may be an on-board controller on the refrigerator or may be the controller associated with the home energy manager or home energy gateway (HEM/HEG). This ambient air dry-bulb temperature information, along with humidity data from humidity sensor 230, allows the controller 220 to calculate the dew point temperature of the ambient environment in a manner known in the art, i.e., a transfer function. Thus, the sensors 210, 230, which may be located in separate locations, or may be part of a single module, provide psychometric data to the controller 220.

In addition, a second temperature sensor 240 is provided in the preselected region 200 and is operative to detect a surface temperature of the preselected region of the housing. The second temperature sensor 240 likewise conveys temperature data regarding the preselected region or surface of the metal housing to the controller 220. In addition to calculating the dew point temperature of the ambient environment, the controller 220 undertakes a comparison of the preselected region surface temperature data received from the second temperature sensor 240 with the dew point temperature calculated from the psychometric data received from the first temperature sensor 210 and the humidity sensor 230 to determine whether to activate the anti-sweat heaters. Typically, a safety factor is incorporated into the comparison. For example, if the dew point temperature is calculated to be 74° F., it is understood that if the surface temperature of the preselected region reaches this temperature, then sweat or condensate will develop. Thus, a safety factor of a predetermined amount greater than the calculated dew point temperature, one degree (1°), for example, could be used so that if the controller receives data from the second temperature sensor 240 that the surface temperature in the preselected region is 75° or less, then the anti-sweat heater(s) is enabled to raise the temperature of the metal housing further away from the dew point temperature. Likewise, once the temperature of the preselected region 200 is increased a predetermined amount above the calculated dew point temperature, e.g., two degrees (2° F.), the anti-sweat heater may then be disabled via a signal received from the controller 220 to the appliance. Of course, one skilled in the art will recognize that these values are exemplary only and should not be deemed to limit the present disclosure.

The temperature sensor 210 and humidity sensor 230 may be part of a module or a combination temperature/humidistat as is commercially available in the industry. These transducers provide the desired electrical data to the controller 220. Similarly, the second temperature sensor 240 may be an electronic transducer such as a thermistor, thermocouple, resistance temperature device, or any other temperature measuring device that supplies the temperature data to the controller.

The second temperature sensor 240 is placed in the door area between the fresh food and freezer compartments in a region 200 where moisture is most likely to accumulate due to condensation. To assure that this is the incipient moisture forming region, the insulation may be reduced in the preselected region 200. Thus, the anti-sweat heater is already located in this condensate-prone area and specifying a location by reducing insulation in this region allows the condensate issue to be addressed before the moisture coalesces and becomes a potential problem. Thus, moisture at this specific location disappears due to a rise in temperature when the anti-sweat heater is activated.

The sensors 210, 230 or single module that monitor the ambient air dry-bulb temperature and humidity may be located at an alternative location as long as the temperature and humidity conditions in the room are effectively determined. For example, the sensors may be located at an inlet to the condenser where return air is coming from the room to the refrigerated appliance. Alternatively, the module may be located along the front grill. Although these are preferred locations, one skilled in the art will appreciate that still other locations that effectively monitor the ambient conditions may be used without departing from the scope and intent of the present disclosure. The software and the microprocessor controller 220 may use a set point to assure that sweat is not formed. This allows the heater to cycle on and off with a hysteretic control, e.g., if the dew point 74° F., then the controller may establish a set point of 76° F.+/−1° F.

As the moisture disappears due to a rise in temperature, the anti-sweat heaters can be again disabled to shed load or energy. This process may be repeated throughout the demand response event. Imposing a void in the insulation behind the mullion bar or another specific region of the housing, and likewise strategically locating the temperature sensor on the housing surface at that location, is also desired. As a result, the strategic location on the mullion bar will become the first location where sweat would likely form. Likewise, one could experimentally determine a different strategic location on the mullion bar or other external surface where the temperatures will be minimal due to the inherent design and locate the sensors at this location.

It will be appreciated that sensing the moisture or sweat early in the process can be helpful in preventing formation of beads of water. Thus, positioning the sensor in an area where the anti-sweat heater is located and where those skilled in the art expect sweat to form in the absence of the heater being on would be advantageous.

As a result of using the concepts of the present disclosure, one demand supply response to a peak pricing period can now be to turn off the mullion heaters since the inactivated anti-sweat heaters can be selectively turned on once the sweat or moisture is detected. It is also contemplated that if the energy savings period is still active, another response is to reduce the voltage or alter the operation of the anti-sweat heaters, e.g., the voltage can be pulsed or proportionally controlled, etc.

The disclosure has been described with reference to the preferred embodiments. Obviously, modifications and alterations will occur to others upon reading and understanding the preceding detailed description. It is intended that the invention be construed as including all such modifications and alterations.

What is claimed is:

1. A refrigerated appliance comprising:

a housing enclosing a cooled storage compartment;

an anti-sweat heater for warming at least a portion of the housing;

a controller operatively connected to one or more power consuming devices of the refrigerated appliance, the controller being configured to receive and process a demand response signal and in response thereto operate the appliance in one of a plurality of operating modes including at least a normal operating mode and an energy savings mode, the controller being configured in at least the energy savings mode to inactivate the anti-sweat heater and to at least selectively activate the anti-sweat heater for at least a limited time period during the energy savings mode to limit incipient moisture formation;

a first temperature sensor and a humidity sensor operative to detect an air dry-bulb temperature and humidity, respectively, of an ambient environment near the refrigerated appliance and convey ambient temperature and humidity data to the controller to calculate a dew point temperature; and a second temperature sensor disposed in a preselected area of the housing defining an indentation where moisture is likely to accumulate due to condensation, the second temperature sensor being operative to detect a surface temperature of the preselected region of the housing and convey preselected region surface temperature data to the controller, wherein the controller compares the preselected region surface temperature data with the calculated dew point temperature to determine whether to activate the anti-sweat heater.

2. The refrigerated appliance of claim 1 wherein the preselected region of the housing has a reduced insulation relative to adjacent regions of the housing.

3. The refrigerated appliance of claim 1 wherein the preselected region is located on a mullion.

4. The refrigerated appliance of claim 1 wherein the controller activates the anti-sweat heater when the surface temperature data approaches the calculated dew point temperature.

5. The refrigerated appliance of claim 1 wherein the controller automatically overrides the inactive status of the anti-sweat heater and activates the anti-sweat heater in the energy savings mode in response to the surface temperature approaching the calculated dew point.

6. The refrigerated appliance of claim 1 wherein the second temperature sensor is an electronic transducer.

7. The refrigerated appliance of claim 6 wherein the electronic transducer is one of a thermocouple, thermistor, and resistance temperature device.

8. The refrigerated appliance of claim 1 wherein the controller is operative to continue energization of the anti-sweat heater for either a pre-specified time or until a set point temperature threshold is exceeded after the second temperature sensor indicates that the preselected region temperature is above the calculated dew point to prevent short-cycling of the anti-sweat heater by the controller.

9. A control method for a refrigerated appliance, comprising:

receiving a demand response signal indicative of at least a peak demand period and an off-peak demand period;

operating the appliance in a normal mode during the off-peak demand period;

operating the appliance in an energy savings mode during the peak demand period;

disabling an anti-sweat heater operatively associated with a housing of the appliance during the peak demand period;

sensing a surface temperature of a preselected region of the housing defining an indentation where moisture is likely to accumulate due to condensation, calculating an ambient dew point adjacent the appliance by monitoring the air dry bulb temperature and humidity of the ambient air adjacent the appliance;

comparing the surface temperature with the calculated dew point; and enabling the anti-sweat heater during the peak demand period when the surface temperature of the preselected region of the housing approaches the calculated dew point.

10. The method of claim 9 wherein the enabling step includes automatically overriding the demand response signal and activating the anti-sweat heater.

11. The method of claim 9 wherein the enabling step includes creating a location on the housing where moisture will initially form and locating a sensor on the housing at the created location.

12. The method of claim 11 wherein the enabling step includes providing reduced thermal insulation on the housing at the created location to encourage moisture to initially form at the created location prior to forming on adjacent surfaces.

13. The method of claim 9 wherein the enabling step is operational for a preselected time period after the surface temperature sensor has exceeded the calculated dew point to prevent short-cycling of the anti-sweat heater.

14. A refrigerator comprising:

a housing enclosing a cooled storage compartment;

an electrical anti-sweat heater incorporated into a region of the housing susceptible to moisture or fog in a high humidity environment;

a first electronic transducer for detecting an air dry-bulb temperature of an ambient environment adjacent the refrigerator and a second electronic transducer for detecting humidity of the ambient environment near the refrigerator, and a third electronic transducer for detecting a surface temperature of a preselected surface region of the refrigerator, the preselected region defining an indentation where moisture is likely to accumulate due to condensation; and a controller operatively connected to one or more power consuming devices of the refrigerator, the controller being configured to receive and process a demand response signal and in response thereto operate the refrigerator in one of a plurality of operating modes including at least a normal operating mode and an energy savings mode, the controller being further configured to receive ambient air dry-bulb temperature and ambient humidity data and surface temperature data from the first, second and third electronic transducers, respectively, and to process this data to calculate a dew point temperature, and to activate the anti-sweat heater in the energy savings mode when the surface temperature sensed by the third electronic transducer approaches the calculated dew point temperature.

15. The refrigerator of claim 14 wherein the refrigerator further comprises a cooling system for cooling the storage compartment comprising an evaporator, a condenser and a compressor, and wherein the first and second electronic transducers monitor air temperature proximate to the condenser.

16. The refrigerator of claim 14 wherein the third electronic transducer is located at a region that has a reduced amount of thermal insulation compared to adjacent areas of the refrigerator susceptible to moisture accumulation in a high humidity environment.

17. The refrigerator of claim 14 wherein the controller cycles the anti-sweat heaters on and off around a set point above the calculated dew point.

* * * * *